US009200797B1

(12) United States Patent
McNulty

(10) Patent No.: US 9,200,797 B1
(45) Date of Patent: Dec. 1, 2015

(54) SELF-ILLUMINATING HAIR HIGHLIGHTS

(71) Applicant: Deborah McNulty, West Hollywood, CA (US)

(72) Inventor: Deborah McNulty, West Hollywood, CA (US)

( * ) Notice: Subject to any disclaimer, the term of this patent is extended or adjusted under 35 U.S.C. 154(b) by 0 days.

(21) Appl. No.: 14/101,601

(22) Filed: Dec. 10, 2013

(51) Int. Cl.
*F21V 33/00* (2006.01)

(52) U.S. Cl.
CPC ..... *F21V 33/0004* (2013.01)

(58) Field of Classification Search
CPC ..... F21V 33/00; F21V 21/088; A45D 8/00; A45D 2008/008; F21L 11/00; Y10S 2/90
USPC ..... 362/257
See application file for complete search history.

(56) References Cited

U.S. PATENT DOCUMENTS 3,450,872 A * 6/1969 Samuel, Jr. ..... F21L 7/00 362/104
3,501,628 A * 3/1970 Madden ..... F21L 14/00 362/104
4,894,757 A * 1/1990 Frusha ..... F21L 11/00 362/103
4,998,186 A * 3/1991 Cocca ..... A44C 15/0015 132/275
D495,449 S * 8/2004 Kellmann ..... D28/92
7,131,743 B2 * 11/2006 Leason ..... A44C 15/0015 2/905
7,731,378 B2 * 6/2010 Dutcher ..... 362/103
7,784,961 B1 * 8/2010 Rawlings ..... F21S 2/00 362/123
D652,167 S * 1/2012 Bonang ..... D28/42
2002/0149936 A1 * 10/2002 Mueller ..... F21V 21/088 362/249.01
2003/0015213 A1 * 1/2003 Sartena ..... 132/275
2004/0031287 A1 * 2/2004 Leason et al. ..... 63/1.13
2004/0163660 A1 * 8/2004 Kellmann ..... A41G 5/0073 132/201
2012/0186602 A1 * 7/2012 Hsu ..... 132/277

* cited by examiner

*Primary Examiner* — Tracie Y Green
(74) *Attorney, Agent, or Firm* — Kyle A. Fletcher, Esq.

(57) ABSTRACT

The self-illuminating hair highlights is constructed of a first wire that includes a plurality of lights equally spaced thereon, and which is configured to attach to hair. A clip secures the first wire and the plurality of lights to the hair. A battery is secured to the first wire and provides electrical communication to the plurality of lights. An electrical wire is wrapped around the first wire in order to transmit electricity from the battery to the plurality of lights. The lights are evenly spaced along the first wire.

11 Claims, 3 Drawing Sheets

SELF-ILLUMINATING HAIR HIGHLIGHTS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of hair highlight accessories, more specifically, an accessory that illuminates hair using lights.

SUMMARY OF THE INVENTION

An embodiment of the disclosure meets the needs presented above by generally comprising of a hair highlight accessory that includes a first wire that includes a plurality of lights equally spaced thereon, and which is configured to attach to hair. A clip secures the first wire and the plurality of lights to the hair. A battery is secured to the first wire and provides electrical communication to the plurality of lights. An electrical wire is wrapped around the first wire in order to transmit electricity from the battery to the plurality of lights. The plurality of lights are evenly spaced along the first wire.

An object of the invention is to provide a device that illuminates hair using a string onto which is secured a plurality of lights, and which is self-illuminating once attached to the users hair.

These together with additional objects, features and advantages of the self-illuminating hair highlights will be readily apparent to those of ordinary skill in the art upon reading the following detailed description of presently preferred, but nonetheless illustrative, embodiments of the self-illuminating hair highlights when taken in conjunction with the accompanying drawings.

In this respect, before explaining the current embodiments of the self-illuminating hair highlights in detail, it is to be understood that the self-illuminating hair highlights is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the self-illuminating hair highlights.

It is therefore important that the claims be regarded as including such equivalent construction insofar as they do not depart from the spirit and scope of the self-illuminating hair highlights. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
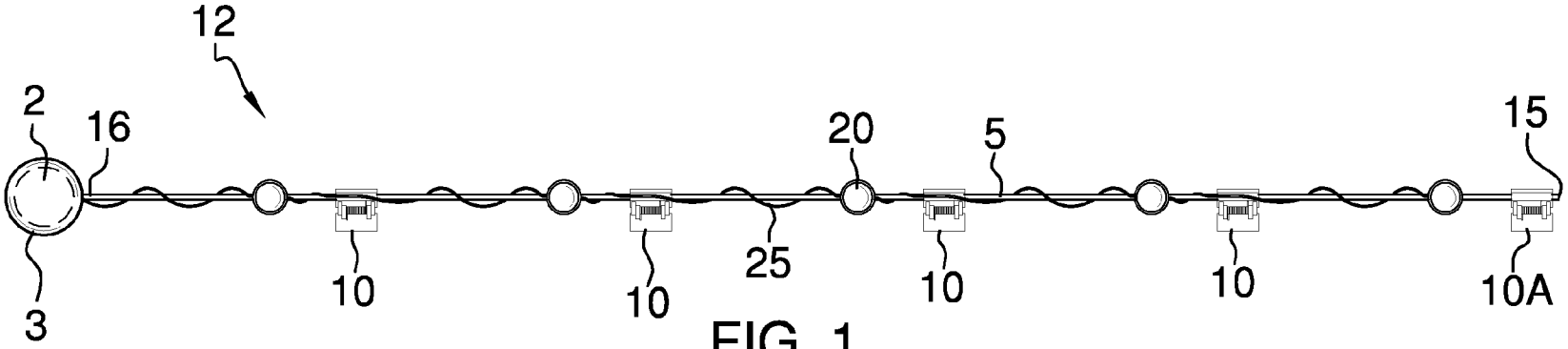
FIG. 1 is a top perspective view of a hair highlight accessory according to an embodiment of the disclosure.
Figure 2:
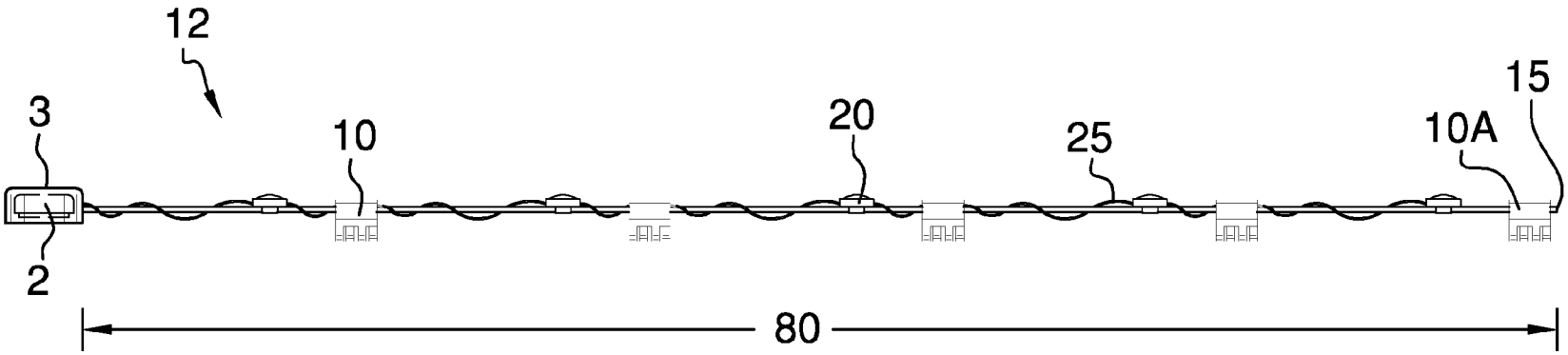
FIG. 2 is a front perspective view of an embodiment of the disclosure.
Figure 3:
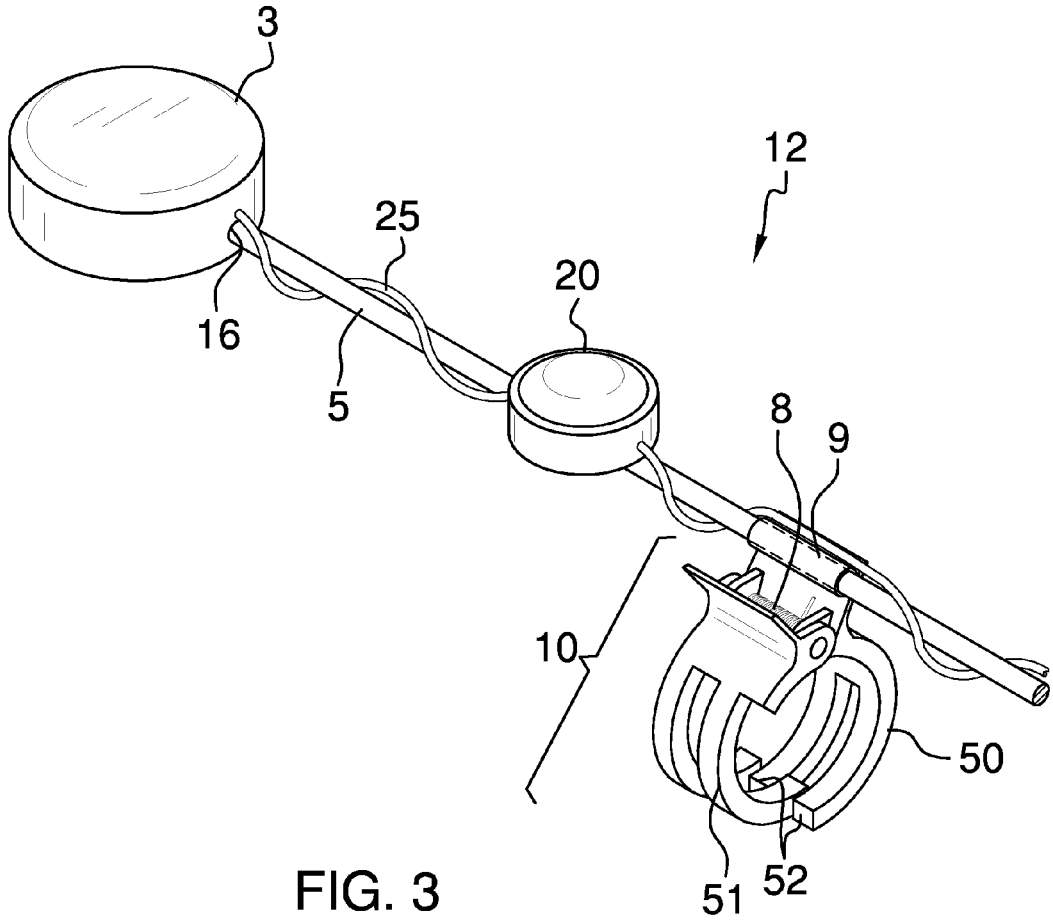
FIG. 3 is a detail view of an embodiment of the disclosure.
Figure 4:
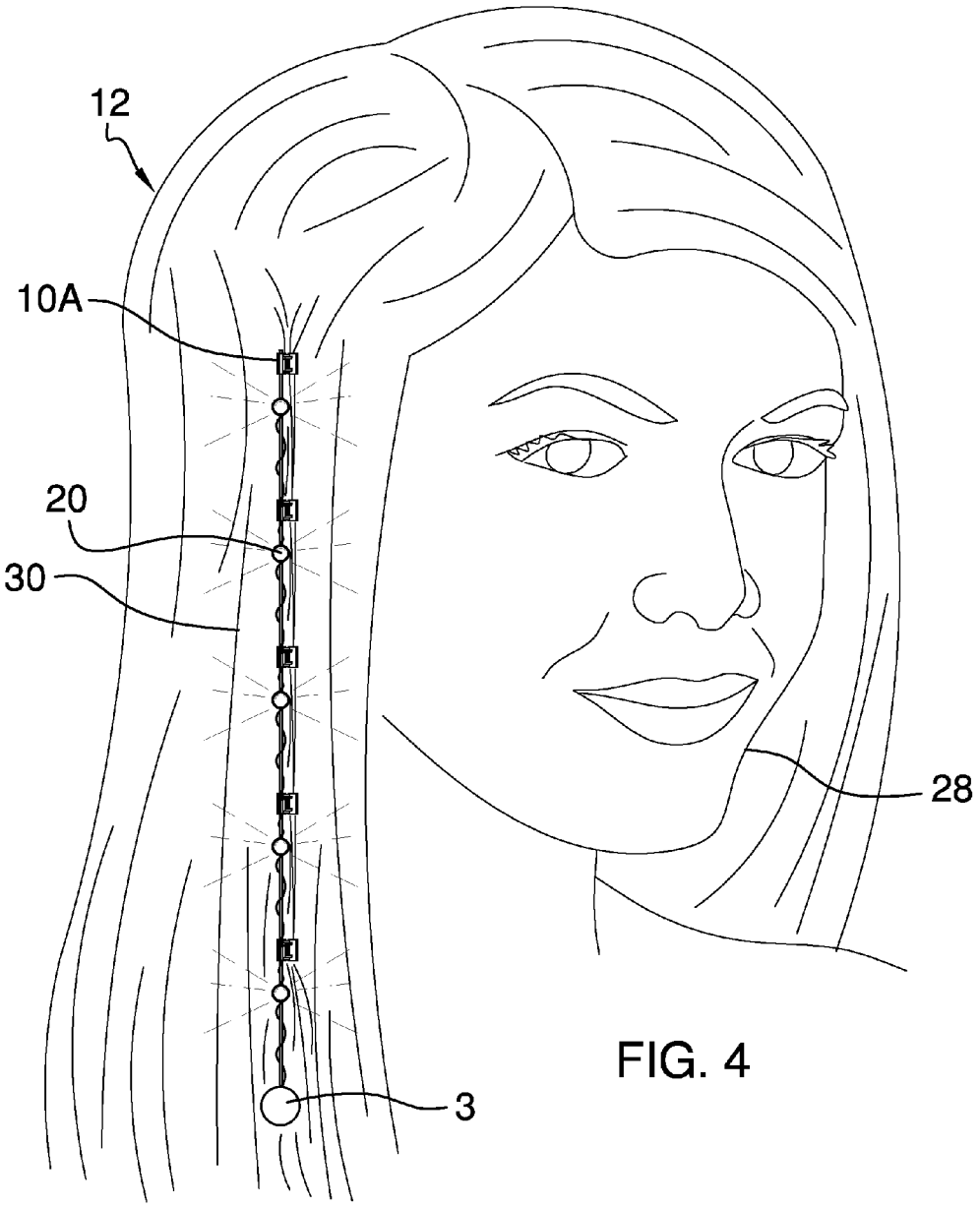
FIG. 4 is an in-use view of an embodiment of the disclosure.

As best illustrated in FIGS. 1 through 4, the highlight accessory 12 generally comprises a first wire 5 that is positionable on the hair 30. The first wire 5 abuts the hair 30 from a first end 16 to a second end 15 of the hair 30. The first wire 5 may have a length 80 no less than 1 inch, and note more than 36 inches. The first wire 5 is positioned on an end user 28 in a vertical orientation. Moreover, the first wire 5 may be of any type of material, which is flexible. It is important to note that the first wire 5 must be able to bend freely.

The highlight accessory 12 includes a plurality of clips 10 that are evenly distributed from the first end 16 to the second end 15 of the first wire 5. Moreover, the clips 10 each contain a spring 8 that allows an adjustment of the amount of hair 30 to which the clip 10 can be attached. The clip 10 is comprised of a retained portion 50 and a moveable portion 51. The retained portion 50 and the moveable portion 51 each have fingers 52 that are oriented towards one another, and that are slideably engaged with respect to one another in order to close off the clip 10.

The clip 10 includes a coupling channel 9 that attaches to and extends downwardly from the retained portion 50 of the clip 10. The coupling channel 9 is constructed of a tubular member that is rigidly affixed to the first wire 5 such that the clip 10 is perpendicularly oriented with respect to the first wire 5. The first wire 5 extends through the coupling channel 9 so the plurality of clips 10 is retained on the flexible first wire 5. The coupling channel 9 allows rotation of the flexible first wire 5 within the coupling channel 9.

The Battery 2 is located at the first end 16 of the first wire 5 within a battery case 3. The battery case 3 houses the battery 2 at the first end 16 of the first wire 5 such that as the highlight accessory 12 is weighed downwardly with respect to the hair 30 of the end user 28. Once the first wire 5 is attached to the hair 30, the battery 2 and the first end 16 are positioned hanging towards the ground. Moreover, a topmost clip 10A is provided at the second end 15 of the first wire 5, and supports the highlight accessory 12 from a highest position with respect to the hair 30 of the end user 28. It shall be noted that the topmost clip 10A is located at the second end 15, which is opposite of the battery case 3 at the first end 16.

The highlight accessory 12 includes an electrical wire 25 that travels the length 80 of the first wire 5 from the first end 16 to the second end 15. The electrical wire 25 carries the electrical current from the battery 2 to a plurality of lights 20 that are positioned along the length 80 of the first wire. Moreover, the electrical wire 25 is wrapped around the first wire 5 in a twisting pattern from the first end 16 to the second end 15. The electrical wire 25 is in electrical communication between the battery 2 to the plurality of lights 20. The plurality of lights 20 may be incandescent or light emitting diode.

The lights 20 of the highlight accessory 12 are affixed to the first wire 5 from the first end 16 to the second end 15. Moreover, the plurality of lights 20 are evenly spaced along the length 80 of the wire 5. Electrical current from the battery 2 is carried through the electrical wire 25 down the first wire 5 to the plurality of lights 20.

In use, the end user 28 positions the highlight accessory 12 on a selected portion of the hair 30. Continuing, the end user 28 adjusts the clips 10 to ensure the topmost clip 10A is at a desired position on the hair 30. The end user 28 uses the position of the highlight accessory 12 to place the plurality of lights 20 at desired position to achieve the illuminated effect of hair 30.

With respect to the above description, it is to be realized that the optimum dimensional relationship for the various components of the accessory 12, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the accessory 12.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A hair accessory for providing illumination comprising:
a first wire configured for use with hair of an end user;
a plurality of clips are coupled to said first wire, and said clips are configured for use in affixing the hair accessory to the hair;
a plurality of lights are attached to the first wire, and are configured to illuminate the hair when affixed to the hair of the end user;
an electrical wire conducts electricity from a battery to said lights;
the electrical wire is wrapped around said first wire;
wherein the first wire is further defined with a first end and a second end, which form a length that is not less than 1 inch, but not more than 36 inches; wherein the first wire is constructed of a flexible material so as to bend freely;
wherein the first wire shall be in a vertical orientation when attached to the hair of the end user;
wherein the plurality of clips are evenly distributed from the first end to the second end of the first wire;
wherein the clips are each further defined with a spring that enables an adjustment of the amount of hair to which the clip can be attached;
wherein the clip is further defined with a retained portion and a moveable portion; wherein the retained portion and the moveable portion each have fingers that are oriented towards one another, and are slideably engaged with respect to one another; wherein the fingers are generally parallel with one another;
wherein the clip includes a coupling channel that attaches to and extends downwardly from the retained portion of the clip; wherein the coupling channel is constructed of a tubular member that is rigidly affixed to the first wire such that the clip is perpendicularly oriented with respect to the first wire; wherein the first wire extends through the coupling channel so the plurality of clips are retained on the flexible first wire.

2. The hair accessory according to claim 1 wherein the plurality of lights are evenly distributed along the length of the first wire; wherein the plurality of lights are each located between successive clips.

3. The hair accessory according to claim 2 wherein the plurality of clips include a topmost clip that is provided at the second end of the first wire, and which designates the highest location of the hair accessory with respect to the hair of the end user.

4. The hair accessory according to claim 3 wherein the battery is located at the first end of the first wire within a battery case; wherein the battery case houses the battery at the first end of the first wire such that as the highlight accessory is weighed downwardly with respect to the hair of the end user.

5. The hair accessory according to claim 4 wherein the electrical wire travels the length of the first wire from the first end to the second end; wherein the electrical wire carries the electrical current from the battery to the plurality of lights that are positioned along the length of the first wire.

6. The hair accessory according to claim 5 wherein the electrical wire is wrapped around the first wire in a twisting pattern from the first end to the second end; wherein the electrical wire is in electrical communication between the battery to the plurality of lights; wherein the plurality of lights are either an incandescent bulb or a light emitting diode.

7. A hair accessory for providing illumination comprising:
a first wire configured for use with hair of an end user;
a plurality of clips are coupled to said first wire, and said clips are configured for use in affixing the hair accessory to the hair;
a plurality of lights are attached to the first wire, and are configured to illuminate the hair when affixed to the hair of the end user; and
an electrical wire conducts electricity from a battery to said lights;
the electrical wire is wrapped around said first wire;
wherein the first wire is further defined with a first end and a second end, which form a length that is not less than 1 inch, but not more than 36 inches; wherein the first wire is constructed of a flexible material so as to bend freely;
wherein the first wire shall be in a vertical orientation when attached to the hair of the end user;
wherein the plurality of clips are evenly distributed from the first end to the second end of the first wire;
wherein the clips are each further defined with a spring that enables an adjustment of the amount of hair to which the clip can be attached;
wherein the clip is further defined with a retained portion and a moveable portion; wherein the retained portion and the moveable portion each have fingers that are oriented towards one another, and are slideably engaged with respect to one another; wherein the fingers are generally parallel with one another;

wherein the clip includes a coupling channel that attaches to and extends downwardly from the retained portion of the clip; wherein the coupling channel is constructed of a tubular member that is rigidly affixed to the first wire such that the clip is perpendicularly oriented with respect to the first wire; wherein the first wire extends through the coupling channel so the plurality of clips are retained on the flexible first wire;

wherein the plurality of lights are evenly distributed along the length of the first wire; wherein the plurality of lights are each located between successive clips.

8. The hair accessory according to claim 7 wherein the plurality of clips include a topmost clip that is provided at the second end of the first wire, and which designates the highest location of the hair accessory with respect to the hair of the end user.

9. The hair accessory according to claim 8 wherein the battery is located at the first end of the first wire within a battery case; wherein the battery case houses the battery at the first end of the first wire such that as the highlight accessory is weighed downwardly with respect to the hair of the end user.

10. The hair accessory according to claim 9 wherein the electrical wire travels the length of the first wire from the first end to the second end; wherein the electrical wire carries the electrical current from the battery to the plurality of lights that are positioned along the length of the first wire.

11. The hair accessory according to claim 10 wherein the electrical wire is wrapped around the first wire in a twisting pattern from the first end to the second end; wherein the electrical wire is in electrical communication between the battery to the plurality of lights; wherein the plurality of lights are either an incandescent bulb or a light emitting diode.

* * * * *